United States Patent [19]

Van Horn

[11] Patent Number: 4,717,007

[45] Date of Patent: Jan. 5, 1988

[54] NON-TRAPPING COIN SHUTTLE FOR ELECTRONIC PARKING METER

[75] Inventor: John W. Van Horn, Harrison, Ark.

[73] Assignee: Qonaar Corporation, Rolling Meadows, Ill.

[21] Appl. No.: 853,007

[22] Filed: Apr. 17, 1986

[51] Int. Cl.[4] ..... G07F 1/04; G07F 1/00

[52] U.S. Cl. ..... 194/343; 194/345

[58] Field of Search ..... 194/202, 335, 342, 343, 194/344, 345, 346, 347, 321, 323, 351

[56] References Cited

U.S. PATENT DOCUMENTS 2,416,213 2/1947 Partin ..... 194/345 X 2,461,314 2/1949 Davis et al. ..... 194/343 X

*Primary Examiner*—Joseph J. Rolla

*Assistant Examiner*—Edward S. Ammeen

*Attorney, Agent, or Firm*—Jones, Day, Reavis & Pogue

[57] ABSTRACT

A coin acceptance shuttle for electronic parking meters adapted to receive coins, one at a time, from a predetermined family of permitted coins and to laterally transport such coins to the channel inlet of the electronic coin acceptance apparatus. The shuttle includes a manually operated plunger having a coin recess therein defined between the body of the plunger and a pivotally mounted gate. Coins enter the recess through a replaceable housing slot member selected in accordance with the family of coins to be used. The gate member pivots to facilitate full and proper coin exit from the shuttle plunger in the event of a coin jam or the premature return travel of the plunger. The gate includes an offset pivot axis and opposed coin stop bosses whereby the gate may be installed in alternative orientations according to the preselected family of coins to be used.

6 Claims, 8 Drawing Figures

FIG. 1
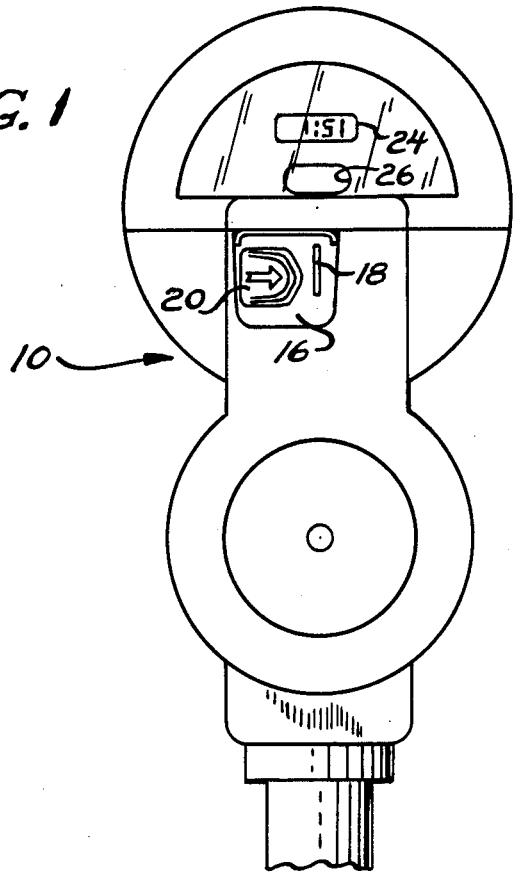
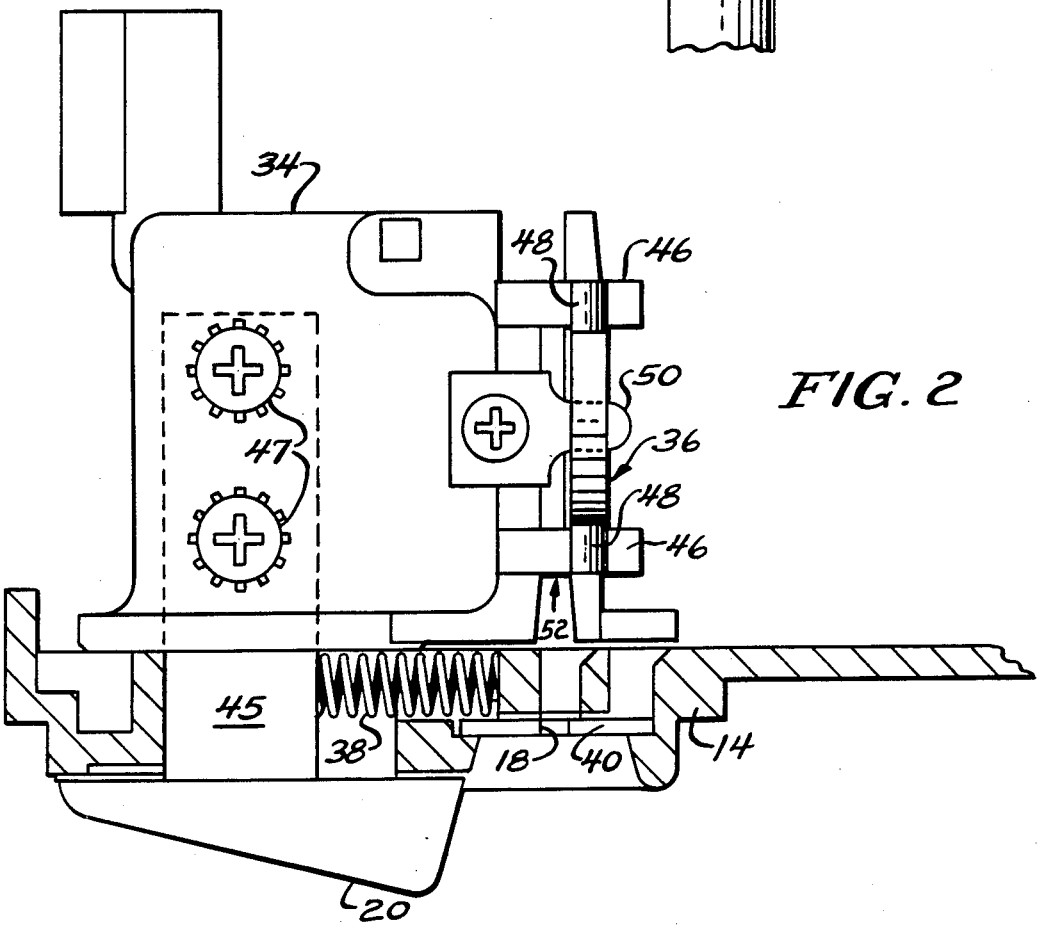
FIG. 2

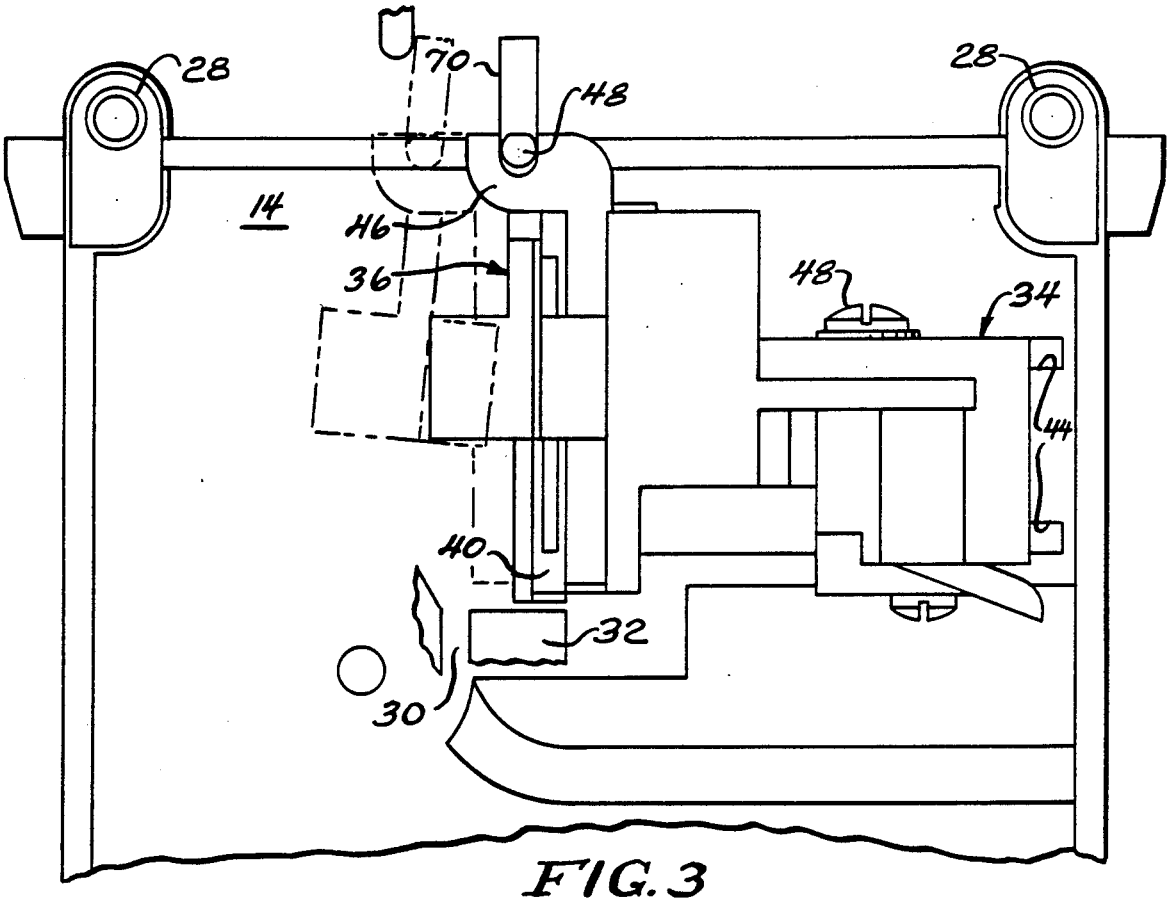
FIG. 3
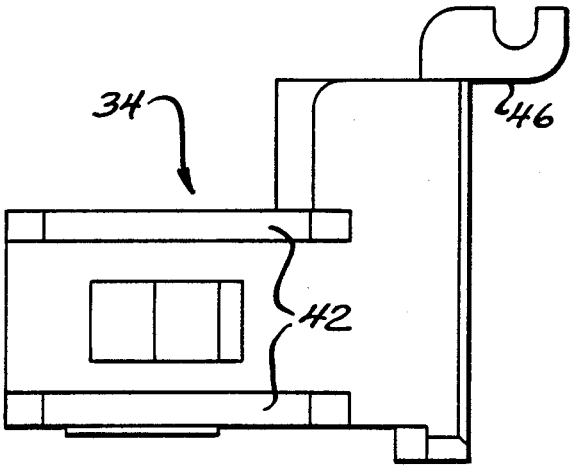
FIG. 4
FIG. 5
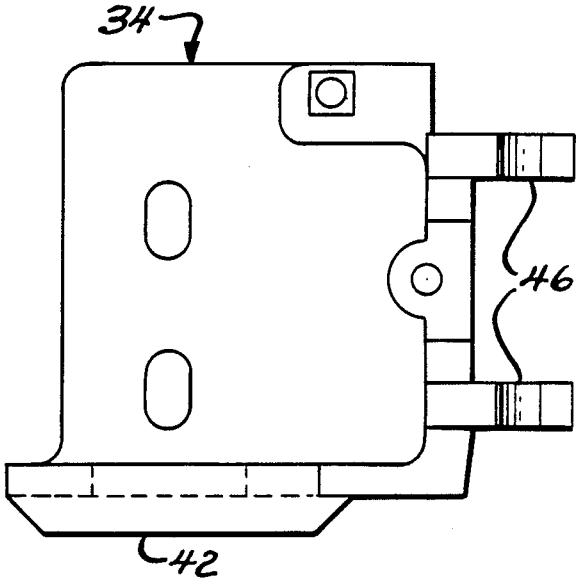

FIG. 6
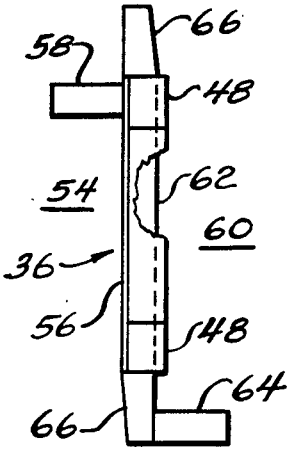
FIG. 7
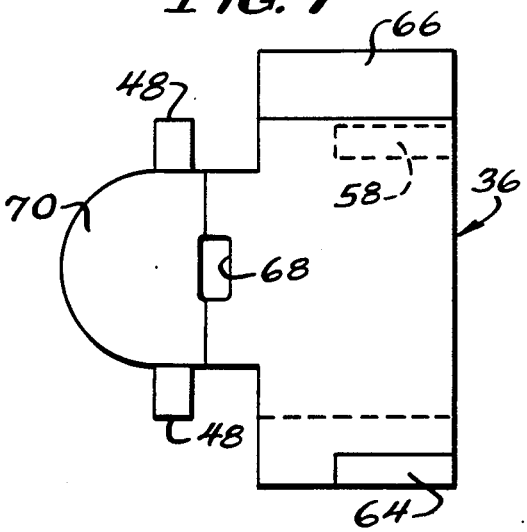
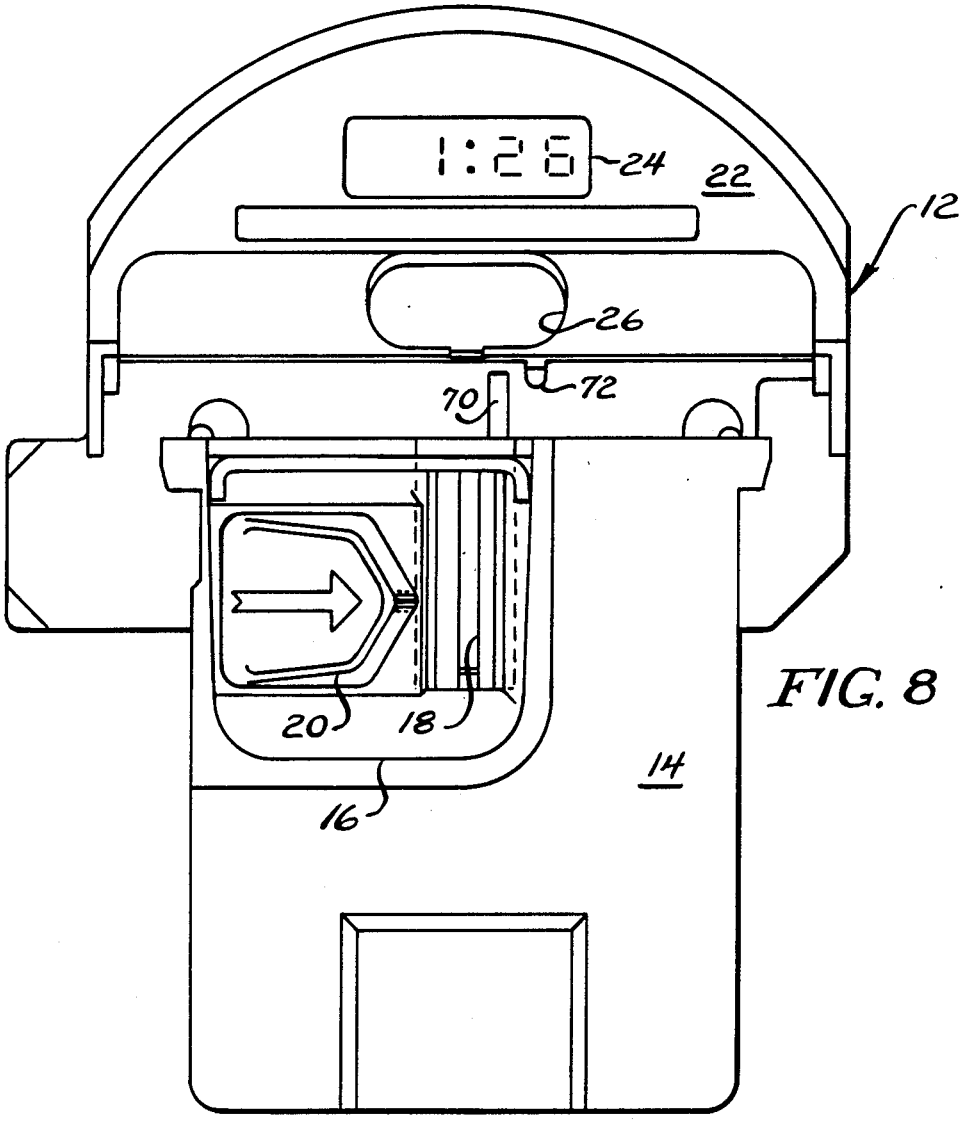
FIG. 8

NON-TRAPPING COIN SHUTTLE FOR ELECTRONIC PARKING METER

The present invention relates to coin recognition and acceptance apparatus and, in particular, to a mechanical coin shuttle input mechanism for use with an electronic parking meter.

Fully mechanical parking meters have been in use for many years. Such meters, however, generally lack flexibility with respect to the type of coins which they can accept; the amount of parking time to be awarded for each coin; and, importantly, recordation of the period or duration of time following meter expiration. In this latter connection, many municipalities assess penalties either following an "excess" or grace period or as a function of the time that the offender has remained parked following expiration. Mechanical meters generally have little or no capability to record excess time.

With the aid of modern, low power integrated circuits, the present assignee recently developed an electronic parking meter utilizing electronic coin recognition and timing control circuitry. This parking meter is described in co-pending application Ser. No. 720,631, filed on Apr. 8, 1985. The electronic coin recognition and discrimination apparatus disclosed therein combines separate coin mass and coin size measurement sub-systems to achieve a reliable determination that a legitimate coin has been inserted into the parking meter. Operation of the coin mass sensor requires the detection of an impulse generated by a piezoelectric transducer upon impact of a coin, which has been permitted to accelerate through a predetermined distance. This impulse is then compared against impulse magnitude of known valid coins.

It will be apparent that the distance through which the coin is permitted to drop, as well as its initial velocity when dropped, must be accurately controlled if proper operation is to be achieved. In short, the opening to the coin recognition apparatus must be isolated from the so-called "outside" world so that the manner in which the coins are inserted by users of the meter will not adversely impact on proper meter operation. For example, it is well known that coins are often shoved or "launched" into the coin slots of vending devices which, if not otherwise buffered or protected, would result in wildly varying initial coin velocities and the rejection of many valid coins by the parking meter.

The present invention, therefore, pertains to a coin input buffering mechanism for receiving coins from parking meter users, thereafter, allowing them to enter an inlet channel of the coin acceptance apparatus at a predetermined point and, initially, at zero velocity. More specifically, the present invention is a manually actuated shuttle arrangement for laterally transporting coins which have been inserted into the input slot of the parking meter, one at a time, until such coins drop into the acceptance apparatus inlet channel.

Early attempts to create a shuttle by placing a coin slot in a laterally moveable plunger whereby the coin would drop downwardly into the inlet channel as the plunger was reciprocated through its normal coin acceptance stroke were known to malfunction. This malfunction was traced to the jamming or trapping of coins in the entrance of the mass detection channel entrance, between the plunger and channel, whenever a coin had not fully entered the channel at the moment the plunger commenced its return stroke. This condition was known to occur whenever the plunger was quickly actuated, that is, not allowed to pause momentarily at the end of its initial lateral stroke. In such instances, no time would be recorded on the meter although the user had placed money therein. And while the coin could generally be dislodged by reapplying pressure to the plunger, assuming that the jam condition was detected, the coin would then continue its downward travel, but from a somewhat lower initial position which, in turn, would result in the piezoelectric mass detector recording an improperly low mass. In addition, this mechanism was found to jam upon the simultaneous insertion of multiple coins.

Further, early approaches to the shuttle design problem were less than completely satisfactory in view of the requirement that parking meters be adjustable or programmable for differing coin sets depending on the locality or country of intended operation. Coins vary both in diameter and thickness and preferably the dimensions of both the meter coin inlet slot as well as the shuttle plunger coin recess should be selected in relation to the set of coins for which the meter is intended to operate.

The present invention utilizes a flapper or gate member pivotally mounted to the shuttle plunger body which functions in the first instance to preclude the trapping or jamming of coins. Additionally, the gate member is dimensioned whereby it may be installed, or reinstalled, in alternative orientations as required to best match the set of coins intended for use with the meter. Specifically, the mounting posts, which form a part of the gate hinge and define the gate pivotal axis, are offset from the centerline of the gate flap such that reversing the mounting of the gate in the mating shoes of the plunger body, which define the stationary portion of the gate hinge, results in a corresponding change in the width of the plunger coin recess. Further, the opposed faces of the gate are provided with protruding bosses which function as stops to limit the inward travel of coins inserted into the meter. These ridges are positioned whereby the maximum coin diameter which the meter can accept may alternatively be selected according to the placement of the gate on the shuttle body. The inlet slot is formed of a separate member insertable into the meter housing whereby the maximum diameter and width of acceptable coins may be further controlled in accordance with the interchangeable slot member placed therein.

It is therefore an object of the present invention to provide an input buffering mechanism for an electronic parking meter or other coin acceptance device adapted to transport coins inserted therein to a coin acceptance or processing portion of the device whereby the coin enters the processing portion having predetermined velocity and position parameters substantially independent of manner of coin insertion by the user.

It is a further object that the buffering mechanism be adaptable to various sized coins and be impervious to jamming or coin trapping under normal operating conditions.

FIG. 1 is a front view of a typical parking meter utilizing the coin shuttle of the present invention;

FIG. 2 is a horizontal view of the shuttle of the present invention mounted in the housing with portions of the shuttle chassis in cross-section to show the shuttle biasing spring and the replaceable coin slot member;

FIG. 3 is a rear elevation view of the coin shuttle of the present invention;

FIG. 4 is a front elevation view of the body of the shuttle;

FIG. 5 is a horizontal view of the shuttle body;

FIG. 6 is a horizontal view of the shuttle gate;

FIG. 7 is a right elevation view of the shuttle gate; and

FIG. 8 is a front elevation view of the electronic parking meter subassembly utilizing the shuttle of the present invention.

DESCRIPTION OF THE PREFERRED EMBODIMENT

A typical electronic parking meter embodying the coin shuttle of the present invention is illustrated in FIG. 1. The parking meter housing 10 is advantageously of a well-known style utilized in connection with mechanical parking meters although any suitable housing may be used. In short, the electronic parking meter, including the coin shuttle of the present invention, was developed as an integral unit or subassembly to facilitate direct substitution for its mechanical counterparts thereby permitting municipalities to upgrade and retrofit their existing mechanical meters with the improved modern electronic mechanisms.

The electronic parking meter subassembly 12, shown in FIG. 8, includes a frame or chassis 14 which is rigidly mounted to housing 10 to secure the electronic subassembly therein. The subassembly includes a raised boss region 16 which extends through a complementary opening in the housing; otherwise, the subassembly is completely enclosed within the locked housing 10 for protection against the elements and vandals. The chassis boss region 16 includes a slot 18 through which coins or tokens are inserted and a shuttle handle 20 for actuating, as discussed below, the shuttle mechanism.

The electronic parking meter subassembly 12 may conveniently be described in terms of three principal components, each rigidly affixed to chassis 14. The first is the display housing 22 which contains a numeric LCD readout 24 of the time remaining, a excess or expired time flag 26, and a jam alert flag (visible only from the rear of the meter). The electronic processing printed circuitry for the meter is also located with display housing 22.

The second principal component is the coin shuttle of the present invention shown mounted to the upper portion of chassis 14 in FIG. 3. The display housing 22, which is ordinarily screwed to chassis standoffs 28, has been omitted from FIG. 3 for clarity. The shuttle and its mounting to chassis 14 are considered in more detail below.

Finally, the third principal component is the electronic coin acceptance apparatus which is mounted to chassis 14 directly below the present coin shuttle. The coin acceptance apparatus is described in detail in the previously identified co-pending U.S. patent application and will not be considered further herein as the specific details of the coin acceptance apparatus are not necessary to an understanding of the present invention. Indeed, it is contemplated that the present coin shuttle may be used with other coin acceptance devices.

An upper portion of the coin acceptance apparatus, however, is depicted in FIG. 3 including the coin inlet channel 30 and coin restricting ridge 32 thereof. Ridge 32 functions to block the downward passage of coins inserted into the shuttle until the shuttle has been actuated, at which time the coin is permitted to drop into the coin acceptance channel 30. This operation is described in more detail below.

Referring to FIGS. 2 and 3, the coin shuttle of the present invention includes the previously noted shuttle handle 20, a shuttle body 34, a coin gate 36, a compression spring 38, and an interchangeable inlet coin slot member 40. Shuttle body 34, depicted in greater detail in FIGS. 4 and 5, includes a pair of spaced, parallel skids 42 which are received within a complementary pair of spaced recesses 44 (FIG. 3) on the interior face of the front wall of chassis 14. The shuttle handle 20 defines a planar face which abutts chassis 14 and includes an integrally formed arm 45 extending therefrom. Arm 45 is positioned through a lateral opening provided in chassis 14 and is rigidly affixed to body 34 by screws 47. In this manner, the chassis is effectively sandwiched between the shuttle handle and body thereby retaining the lever and body for lateral sliding motion thereon. Compression spring 38, retained within a recess formed in chassis 14, biases the shuttle assembly to the left into its nominal non-activated position whereby coins may be inserted into the shuttle mechanism through slot 18.

The shuttle body further includes a pair of spaced shoes 46 extending outwardly from the upper righthand edge of the body. These shoes are adapted to receive complementary spaced axial posts 48 of the coin gate 36 thereby pivotally mounting the gate to the body. A metallic finger-shaped spring 50 is screwed to the top of the body to assure proper retention of the gate in shoes 46. The spring additionally biases the gate into its nominal closed position parallel to the right face of body 34.

A coin recess 52 is defined between body 34 and gate 36 which recess, as best shown in FIG. 2, is located immediately behind the meter inlet coin slot 18 when the shuttle is biased leftwardly, by spring 38, into its nominal at rest position. The maximum diameter and width of coins which the coin shuttle can accept is determined by the dimensions of the coin slot 18 and coin recess 52. A properly dimensioned coin slot to accommodate virtually any coin may be selected by inserting an appropriate interchangeable coin slot member 40 in the housing recess provided.

The coin sizes which recess 52 can accommodate are defined in large measure by the dimensions of gate 36. The gate, as described hereinafter, has been designed in a non-symmetric fashion to facilitate its pivotal retention on the shuttle body in alternative orientations whereby a single, or at least fewer, molded gate members are required to cover the coins and tokens intended for use with the meter.

Gate 36 is best illustrated in FIGS. 6 and 7. Referring specifically to FIG. 6, the gate defines a first region or side 54 including a first coin recess face 56 and a first coin stop boss 58 and a second side 60 including corresponding second coin recess face 62 and second coin stop boss 64. Each face includes a tapered or bevelled portion 66 to guide the coin into the shuttle recess and minimize interference by the gate upon coin insertion. A rectangular aperture 68 is provided in the gate to receive spring 50.

Spring 50 biases the gate downwardly into abutting contact with the righthand side of shuttle body below shoes 46. More specifically, the gate is rotated until the respective stop boss 58 or 64 contacts the body. The heights of bosses 58 and 64 are respectively dimensioned so that each extends the same distance, preferably about 0.30 inches, perpendicularly outwardly from the central axis of hinge posts 48. It will be appreciated that the gate may be alternately positioned on the body with either side 54 or 60 facing the body and defining the coin recess 52 (FIG. 2).

As best shown in FIG. 6, the central axis of the hinge posts 48 is offset to the right with respect to the lower portion of the gate member, in particular, with respect to opposed faces 56 and 62. Consequently, the width of shuttle coin recess 52 will be narrower when the gate is installed with the first side 54 facing the body as compared with the alternative installation with the second side 60 facing body 34. The absolute widths defining the coin recess 52 corresponding to the opposed gate faces are, in the first instance, a function of the height of bosses 58 and 64 with the relative widths being a function of the degree of offset of posts 48.

It will also be noted that stop bosses 58 and 64 are not symmetrically positioned, but rather, boss 64 is preferably oriented further from the vertical centerline of the gate than boss 58. As these respective bosses serve, not merely to define the width of recess 52, but additionally as a back wall or stop to limit the rearward travel of a coin inserted into the shuttle, it will be seen that coins of a larger diameter, as well as thicker, are contemplated for use with the shuttle when the second side 60 is operably facing body 34.

The shuttle gate also includes an integral tab 70 which extends vertically above the axis of hinge posts 48. Tab 70 is adapted to engage post 72 integrally molded to display housing 22 (FIG. 8) whenever the shuttle is moved to its extreme right hand position (left as viewed in FIG. 3) thereby causing the gate to pivot outwardly from the body. While it is intended that coins inserted into shuttle recess 52 will ordinarily drop into the coin acceptance apparatus without the above described pivotal movement of gate 36; this automatic opening of the gate and recess upon full shuttle actuation assures that coins cannot be trapped or jammed in the recess. For instance, should a user succeed in forcing two coins into the recess, thereby sandwiching and jamming the coins between body 34 and gate 36, rotation of the gate will release the coins, freeing the jam condition. Without the tab activated pivotal gate arrangement of the present invention, jamming of the shuttle mechanism by reason of the insertion of multiple coins therein would render the meter inoperative until the jam could be removed by service personnel.

The present invention further minimizes or eliminates jamming resulting from the premature return of the shuttle mechanism during actuation. During normal meter operation, the user will urge the shuttle to the right, momentarily holding it there before allowing it to retrace its path back to the deactivated ready condition. This momentary pause is ordinarily sufficient to permit a coin to fully exit the shuttle recess 52. However, it has been observed that on occasion a user will hurriedly actuate the shuttle handle 20 whereby the shuttle will commence its return stroke prior to the coin dropping clear of the shuttle recess.

Without the pivotal gate of the present invention, movement of the shuttle body creates a misalignment between the shuttle coin recess and the coin acceptance mechanism which, in turn, may cause entrapment of a coin caught midway between the shuttle and acceptance apparatus whenever, as noted, the shuttle is hurriedly operated. In the shuttle arrangement of the present invention, by contrast, in the event that the shuttle prematurely commences its return stroke, the gate 36 will pivot thereby minimizing the possibility of coin entrapment.

I claim:

1. Coin shuttle apparatus for electronic parking meters or other coin acceptance apparatus including frame means; a shuttle body; means for retaining the body on the frame means for slidable movement thereon between a first coin receiving position and a second coin transfer position; handle means rigidly connected to the body for manually moving the shuttle body from the first coin receiving position to the second coin transfer position; a shuttle gate, means for pivotally mounting the gate on the body in spaced relationship thereto whereby the space between the body and gate defines a shuttle coin recess; slot means on the frame means, the slot means being adjacent the shuttle coin recess whereby coins may be inserted through the slot means into the coin recess when the body is in the first coin receiving position; means for maintaining coins in the shuttle recess, said maintaining means having an aperture therein through which coins may pass when the shuttle body is in the second coin transfer position whereby coins will pass from the shuttle.

2. Coin shuttle apparatus for electronic parking meters or other coin acceptance apparatus including frame means; a shuttle body; skid means on the shuttle body; channel means in the frame means for receiving the shuttle body skid means; means for retaining the body skid means within the frame channel means for slidable movement therein between a first coin receiving position and a second coin transfer position; handle means rigidly connected to the body for manually moving the shuttle body from the first coin receiving position to the second coin transfer position; a shuttle gate, means for pivotally mounting the gate on the body in spaced relationship thereto whereby the space between the body and gate defines a shuttle coin recess; slot means on the frame means, the slot means being adjacent the shuttle coin recess whereby coins may be inserted through the slot means into the coin recess when the body is in the first coin receiving position; means for maintaining coins in the shuttle recess, said maintaining means having an aperture therein through which coins may pass when the shuttle body is in the second coin transfer position whereby coins will pass from the shuttle.

3. Coin shuttle apparatus for electronic parking meters or other coin acceptance apparatus including frame means; a shuttle body; means for retaining the body on the frame means for slidable movement thereon between a first coin receiving position and a second coin transfer position; handle means rigidly connected to the body for manually moving the shuttle body from the first coin receiving position to the second coin transfer position; a shuttle gate, the gate defining generally planar and parallel first and second surfaces, means for pivotally mounting the gate with one of said surfaces in opposed spaced relationship to the body whereby the space between the body and gate defines a shuttle coin recess; slot means on the frame means, the slot means being adjacent the shuttle coin recess whereby coins may be inserted through the slot means into the coin recess when the body is in the first coin receiving position; means for maintaining coins in the shuttle recess, said maintaining means having an aperture therein through which coins may pass when the shuttle body is in the second coin transfer position whereby coins will pass from the shuttle.

4. The coin shuttle apparatus for electronic parking meters or other coin acceptance apparatus of claim 3 wherein the means for pivotally mounting the gate to the body includes hinge post means on the gate, the post means defining an axis, said axis being in spaced substantially parallel relationship to said gate surfaces, closer to one surface than to the other whereby the width of the coin recess is greater when the gate is mounted with said one surface in opposed relationship and lesser with the other surface in opposed relationship to the shuttle body.

5. The coin shuttle apparatus for electronic parking meters or other coin acceptance apparatus of claim 3 wherein the gate includes first boss means on the first surface and second boss means on the second surface, said boss means forming a rear wall of the coin recess and defining the depth of the coin recess, said depth corresponding to the maximum diameter of a coin that may be inserted into the coin recess, the first and second boss means being positioned on the respective surfaces whereby the maximum recess coin diameter is greater when said one gate surface is in opposed relationship to the body than when the other is in said relationship.

6. Coin shuttle apparatus for electronic parking meters or other coin acceptance apparatus including frame means; a shuttle body; means for retaining the body on the frame means for slidable movement thereon between a first coin receiving position and a second coin transfer position; handle means rigidly connected to the body for manually moving the shuttle body from the first coin receiving position to the second coin transfer position; a shuttle gate, means for pivotally mounting the gate in spaced relationship to the body whereby the space between the body and gate defines a shuttle coin recess; slot means on the frame means, the slot means being adjacent the shuttle coin recess whereby coins may be inserted through the slot means into the coin recess when the body is in the first coin receiving position; means for maintaining coins in the shuttle recess, said maintaining means having an aperture therein through which coins may pass when the shuttle body is in the second coin transfer position whereby coins will pass from the shuttle; tab means on the gate; means in predetermined spaced relationship with the shuttle body and gate for engaging the gate tab means when the shuttle body is moved into the second coin transfer position thereby pivotally rotating the gate outwardly from the shuttle frame means whereby coins trapped in the shuttle coin recess will be released.

* * * * *